US005528659A

United States Patent [19]

Stein

[11] Patent Number: 5,528,659

[45] Date of Patent: Jun. 18, 1996

[54] RADIATION FLUX POLARIZER OR DISTRIBUTOR

[75] Inventor: Russell N. Stein, Andover, N.J.

[73] Assignee: **Gray*Star, Inc.**, Mt. Arlington, N.J.

[21] Appl. No.: 231,849

[22] Filed: Apr. 25, 1994

[51] Int. Cl.[6] ..... G21K 1/02

[52] U.S. Cl. ..... 378/149; 378/154

[58] Field of Search ..... 378/147, 149, 378/194; 250/363.1

[56] References Cited

U.S. PATENT DOCUMENTS

| | | | |
|---|---|---|---|
| 1,551,162 | 8/1925 | Loebell | 378/154 |
| 3,543,384 | 12/1970 | Hansen | 82/47 |
| 3,921,000 | 11/1975 | Muehllehner | 378/149 |
| 3,943,366 | 3/1976 | Platz et al. | 378/149 |
| 4,054,800 | 10/1977 | Leask | 378/149 |
| 4,096,389 | 6/1978 | Ashe et al. | 378/7 |
| 4,433,427 | 2/1984 | Barnea | 378/146 |

*Primary Examiner*—David P. Porta
*Assistant Examiner*—David Vernon Bruce
*Attorney, Agent, or Firm*—Dennison, Meserole, Pollack & Scheiner

[57] ABSTRACT

The invention provides a polarizing device and a method for producing and utilizing the device. The device produces a modification in radiation flux and provides a bias toward photons approaching a target's face at more or less right angles. Accordingly, the radiation flux polarizing device reduces the number of photons that are not traveling at near right angle to the face of a "target" being irradiated, without significantly reducing photons approaching, or reaching the minimum base point in the target. In a sense, the invention converts a normal isotropic radiation source to one that is anisotropic.

21 Claims, 19 Drawing Sheets

CIRCULAR

RECTILINEAR

TRIANGULAR 30

HEXAGONAL 32

RADIATION FLUX POLARIZER OR DISTRIBUTOR

BACKGROUND OF THE INVENTION

1. Field of the Invention

The present invention is a device to modify isotropic gamma radiation fluxes so that doses of radiation received by an irradiated product are uniform. More specifically, the present invention is a device placed between a radiation source and a product being irradiated for reducing (but not eliminating) the number of photons that are not traveling at or near desired angles (e.g. right angles) to the product's face plane, without significantly reducing those approaching the target's face plane at desired angles (e.g. right angles).

When products are irradiated by gamma radiation to produce a beneficial chemical, physical or biological effect, a certain amount of undesirable nonuniformity results. These nonuniformities result from four fundamental factors:

1. the geometry of the radiation sources and of the product, and their geometric relationship to one another;

2. the isotropic nature of the radiation emitted by the radioactive isotope sources;

3. the mass attenuation factors of the materials being irradiated; and 4. the average bulk densities of the materials being irradiated (specific mass involved).

The problem can perhaps best be understood by describing it as "surface burn". The surface of the product being irradiated is overdosed compared to the interior of the product, much the same way that a roast turning on a rotisserie can be burned on the surface while the interior is still raw.

When a product is being irradiated to achieve a specific purpose, it is necessary to make sure that all parts of the product receive at least the amount of radiation required to accomplish the effect desired. This amount of radiation is designated the MINIMUM DOSE (Dmin).

In some cases, however, too much radiation received by the product can produce an undesirable result (product damage) or the dose may exceed a mandatory regulatory agency limit and become "legally tainted". This amount of radiation is called the MAXIMUM RADIATION DOSE (Dmax).

Obviously irradiators are designed to deliver a dose of radiation to all parts of a product that is within these limits (>Dmin, but <Dmax). Unfortunately, to achieve this goal, it has heretofore been necessary to sacrifice the efficiency of the irradiator or of the operations, or both. The two traditional methods to reduce nonuniformity (reduce Dmax/Dmin) is to irradiate "thinner" layers of the product, or increase the distance between the radiation source and the product. The first method sacrifices operational efficiency (increases material product handling), while the second reduces Radiation Utilization Efficiency (the percentage of the radiation usefully absorbed in the product compared to the total amount emitted by the radiation source). The analogy of the roast on the rotisserie still holds; either the roast must be cut into thinner pieces and cooked separately, or moved farther from the flame and thus take longer to cook.

The specific reason for "surface burn" is due to the isotropic nature of the radiation emitted by radioactive isotopes and the "inverse square" phenomenon that results.

All radiation (photons) in the electromagnetic spectrum behave in this manner, including visible light.

SUMMARY OF THE INVENTION

Gamma photons cannot be refracted, reflected or focused as effectively as light photons. As a practical matter, only about one percent of gamma photons can be reflected off a surface, and there is no "lens" available to focus a beam of gamma radiation. Some types of radiation such as beta particles from radioactive isotopes or beams of electrons can be shaped and focused by magnets, but gamma rays are not at all affected by magnetic fields. Extremely intense gravitational fields can "bend" gamma rays (and light waves), such as those produced by massive stars and "black holes" in space, but no practical technology exists to take advantage of these phenomena.

However, gamma radiation can be absorbed, and is, more or less, by all substances. Generally speaking, the higher the atomic number (Z) of an element, the more radiation it will attenuate. In other words, the higher the density of the material, the more effectively it will attenuate, or absorb, gamma radiation. Hence, lead, depleted uranium and iron are commonly used as nuclear shielding materials. If the thickness of a shield is not restrictive, lower density materials can be employed with greater thicknesses, such as concrete or water which are less expensive even though more material is required.

The present invention provides a polarizing or distribution means, and method for producing and utilizing such means, that produces a modification in the radiation flux, which provides a bias toward the photons approaching the target's face at more or less desired angles (e.g. right angles).

Accordingly, it is an object of this invention to provide a radiation flux polarizing or distribution means to reduce the number of photons that are not traveling at or near a desired angle (e.g. a right angle) to the face of a "target" being irradiated, without significantly reducing photons approaching, or reaching the minimum base point in the target. In a sense, the purpose of this invention is to convert a normal isotropic radiation source to one that is anisotropic.

Further objects and advantages of the invention will become apparent from a consideration of the drawings and ensuing description.

DESCRIPTION OF THE INVENTION

Figure 1:
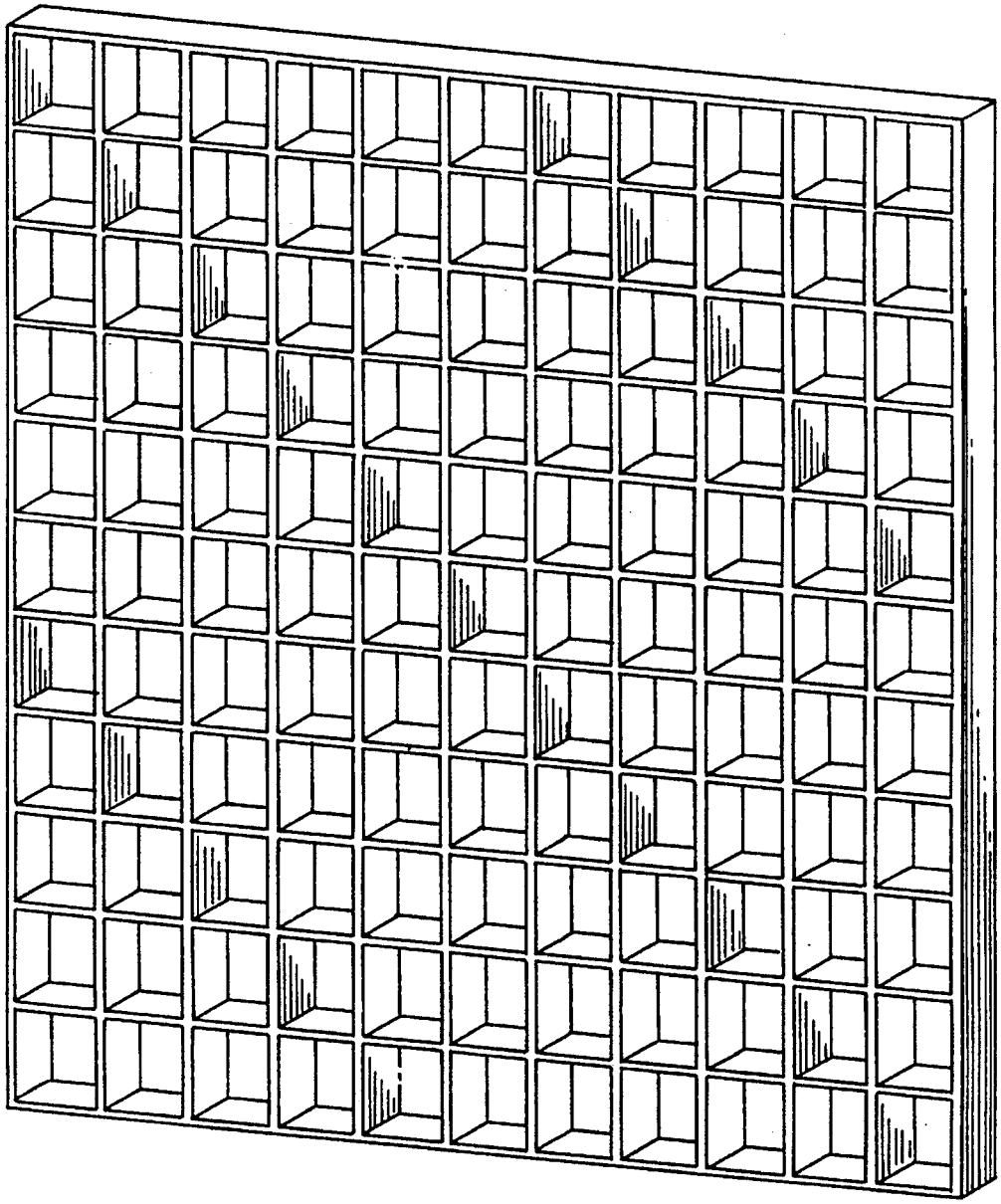
FIG. 1 illustrates an exemplary grid cell pattern in accordance with the present invention.
Figure 2:
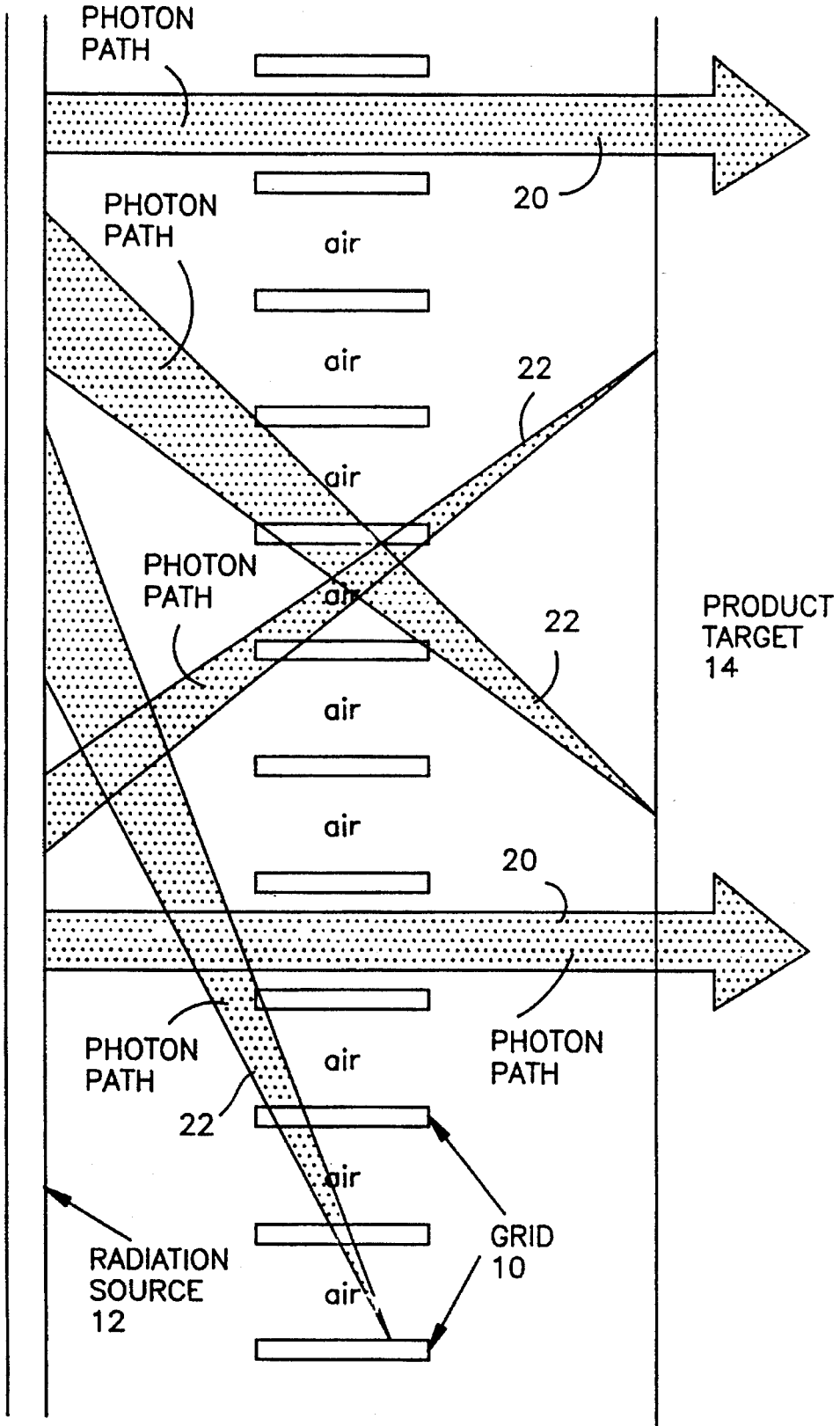
FIG. 2 illustrates an effect the grid cell pattern of FIG. 1 has on photon paths in accordance with the present invention.

With reference to FIGS. 1 and 2, the present invention is directed to means for modifying radiation flux by the use of a radiation flux polarizing grid indicated generally at 10 placed between a radiation source plaque 12 and a product target 14 being irradiated. The grid 10, of an exemplary rectangular geometrical configuration, is made from a very high density material such as lead, depleted uranium or tungsten. The grid 10 is formed having a plurality of wall forming members, or restrictor plates 18,19 defining cells forming photon path through-passage. In this embodiment the restrictor plates 18,19 are positioned at desired angles (i.e. right angles) which in an exemplary vertical use position, results in horizontal portions 18 and vertical portions 19.

As shown in FIG. 2, the paths of gamma photons 20, 22 passing through the grid on their way to the product will either pass directly through, unaffected, if they pass through the space or cell passage, as indicated generally at 20, or will be partially or wholly attenuated by one or more of the restrictor plates 18,19 in the grid 10, as indicated by numeral 22.

The effect of the polarizing or distribution grid 10 of this invention is to reduce the number of photons that are not traveling at or near desired angle (e.g. a right angle) to the target product's face plane, without significantly reducing photons approaching the target product at a desired angle (e.g. right angles). The high surface doses that are normally experienced in prior art irradiators are the result of the photons emitted from the source plaque 12 that approach the product target 14 at an extreme angle, as generally indicated by numeral 22. These "extreme angle" photons are substantially reduced by the grid 10 as shown in FIG. 2.

Figure 3A:
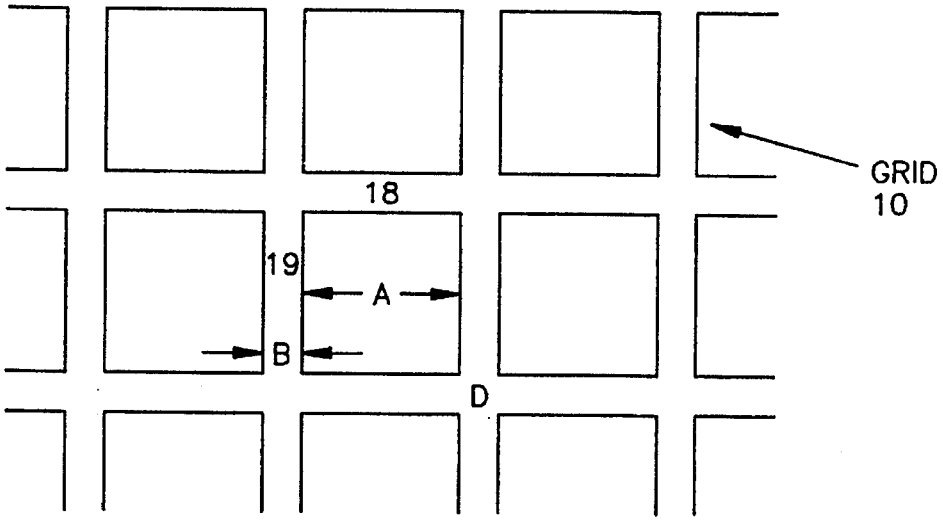
FIGS. 3*a* and 3*b* illustrate variables taken into consideration for the development of a grid cell pattern in accordance with the present invention.
Figure 3B:
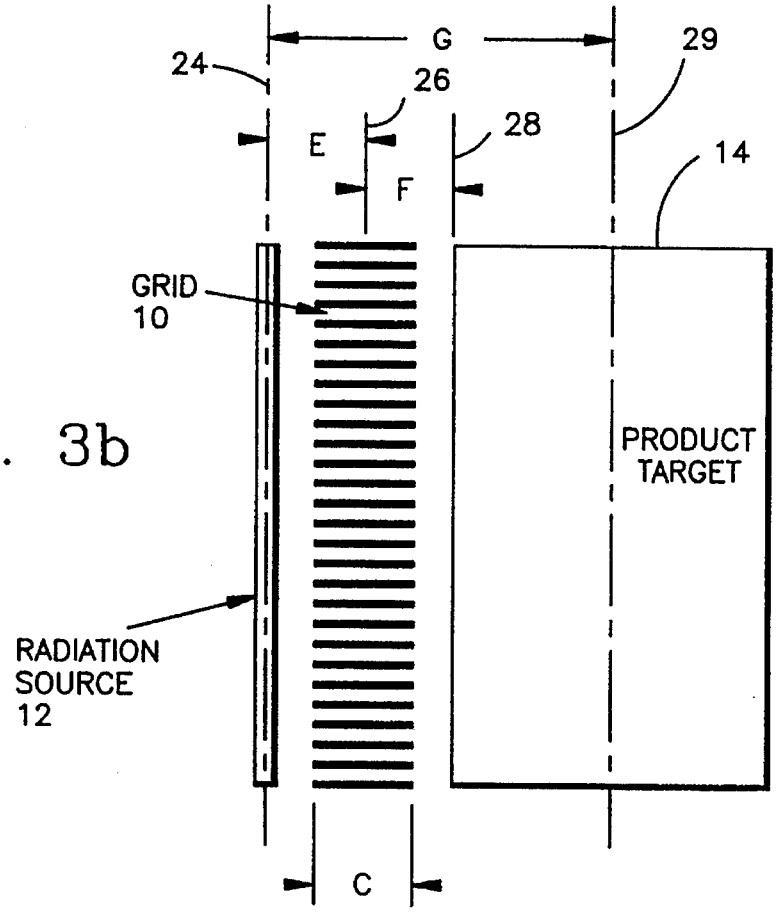

With reference now to FIGS. 3*a* and 3*b*, there are seven variables which control the effectiveness of the grid 10. First is a distance "A" between vertical portions 19. Next, the thickness "B" of the vertical portions 19. The third variable considered is the thickness "C" of grid 10. The fourth variable is the material "D" from which the grid 10 is fabricated. The next variable is the distance "E" from the source plaque 12 at a centerline 24 to a grid centerline 26. The sixth variable is the distance "F" from grid centerline 26 to a face 28 of the product target 14. The last or seventh variable considered is the distance "G" from source centerline 24 to a product centerline 29.

Figure 4:
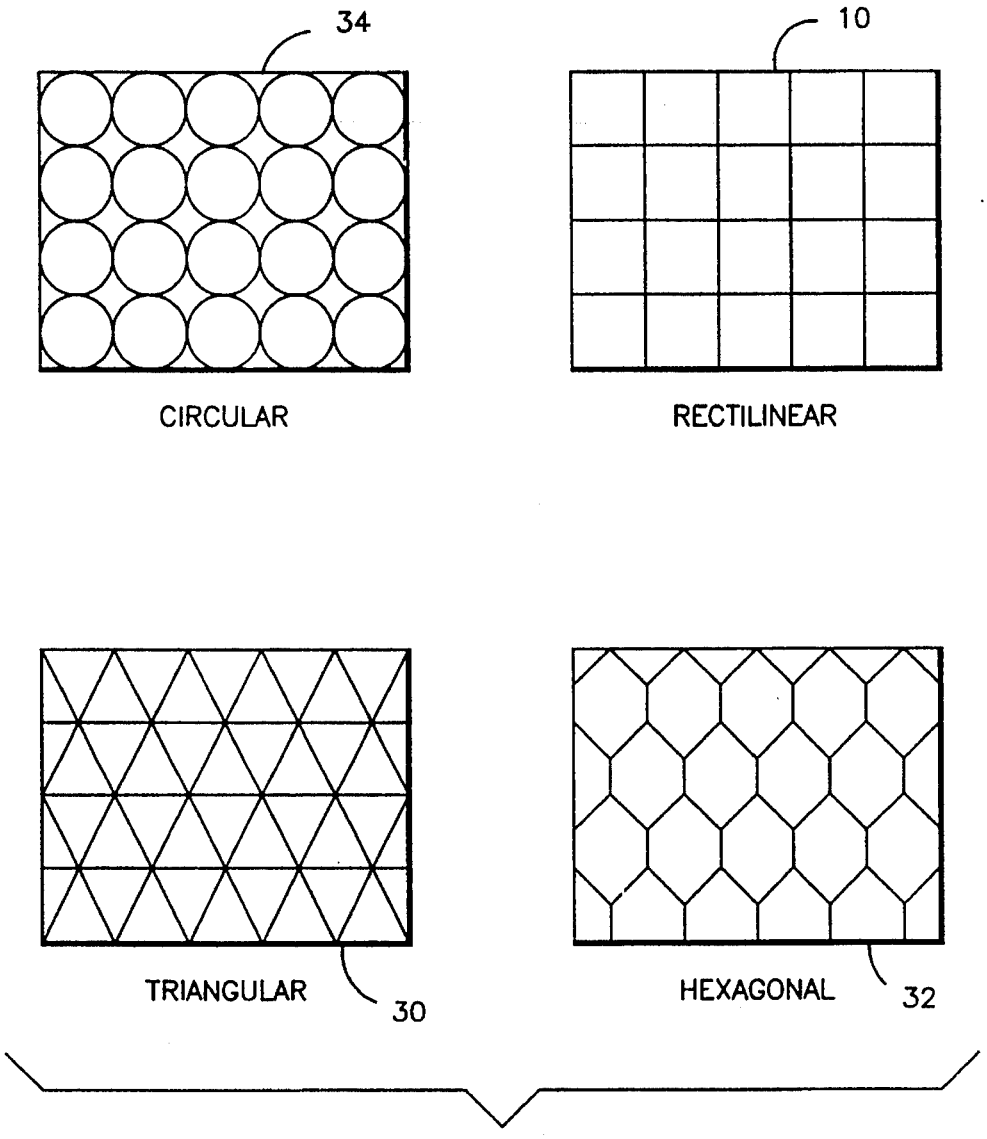
FIG. 4 illustrates further exemplary embodiments of grid cell patterns developed in accordance with the present invention.

The analysis has been carried out for the geometry of the grid 10 shown in FIG. 1 which is rectilinear. However, any number of other grid geometries and combinations can be employed. Other embodiments of grids in accordance with the invention are shown in FIG. 4 which grids have cell configurations that are triangular 30, hexagonal 32, or circular 34. These geometric patterns may be arranged vertically or horizontally, and in some cases it may be desirable to utilize non-uniform patterns, as long as the variable spacing, element thickness, and grid angles used sufficiently polarize or distribute the radiation flux.

By controlling the seven variables, the grids can be designed specifically for irradiators with differing source configurations and for different product densities for the same irradiator. The grid 10 can be retrofit to existing irradiators or incorporated into new irradiator designs.

Accordingly, in a preferred structural configuration of an irradiator utilizing the grid 10, a box of four grids would surround the product target 14 with the grids 10 positioned between the product target 14 and the source plaque 12 to modify and/or control gamma photon flux distribution throughout product target 14. To determine the parameters of the grid 10 cell geometrical configuration and thus flux modifying performance of a grid 10, or grids, trial and error placement of grid cell defining members on a radiation transparent member may be effected and such a test grid tested to determine distribution of radiation in a target product.

In a preferred embodiment of the method of the present invention, a mathematical model is constructed to enable optimization of the cell structure of the grid 10.

As discussed with reference to FIG. 2, the grid 10 polarizes the paths 20, 22 of the gamma photons to allow for maximum useful energy to be absorbed by the product target 14 while limiting photons which are not useful. After creation in the source material, such as Cesium-137, which is an isotope of Cesium used as the source material, the photons travel past or through the grid 10 and into the product 14 where their energy is converted to low grade heat. It can be appreciated that any isotope can be utilized, as long as the desired results are reached.

MATHEMATICAL MODEL

The mathematical modeling technique takes into account the geometries of the positioning of the source plaque 12, the interaction with the grid 10 and the absorption of the photons in the product target 14. Due to the number of specific variables encountered, the modeling is based on Point Kernel calculations that "break down" both the source 12 and the target 14 into specific points and calculates the actual photon path interactions between them. The more points chosen, the better the accuracy. Of course, this is only limited by the total computer processing time available from an economic standpoint.

The present invention selectively limits the path 22 of certain photons. The model "breaks down" the source 12 into as many Kernels as possible to allow for micro geometries. To accomplish this task, a "cell" technique is devised. The cell 16 or mini-source plaque divides its source into twelve vertical and twelve horizontal components for the purpose of Point Kernel calculations. It is comprised of the source 12 surrounded by four layers of restrictor plates 18,19 or grids 10 radiating outward from a source plaque 12 in all directions. The source plaque 12 is defined as a two-dimensional array of Cesium-137 encapsulated in stainless steel. In the embodiment described hereinafter, the source plaque 12 is broken down into a finite number of hypothetical cells 16 both horizontally 18 and vertically 19. This forms the base unit for a multitude of overall source plaque configurations. The model divides the source 12 into a finite number of "cells" which contain the specific geometries for a given grid configuration. Using the Point Kernel technique, a full flux distribution is calculated for a specific density target material, extending out one side of the theoretical source material through a theoretical air gap. The air gap is the distance between the source plaque 12 and the surface or face 28 of product target 14. The number of target points and their positioning are chosen at double the height and width of a theoretical maximum product dimension off of the y and z axis of the centerpoint of the source material. The thickness of the target (x axis) is set to the maximum thickness dimension of the product. After all target points are calculated for a specific cell 16, the cells can be geometrically arrayed for a theoretical source plaque or plaques. Using the cells 16 as source points, the target point dose rates can be accumulated by summing up the various target point's dose rate for each position of the corresponding cell 16.

MODEL ORIENTATION

The Cell model is based on a relational Cartesian coordinate system. The origin is the theoretical point at the center of where the isotropic radiation is created (source point). All dimensional positions are based on the coordinates off of that point. The present model uses inches as its primary unit of distance. The restrictor plates 18,19 of the grid 10 are defined by the nearest point coordinate and the furthest point coordinate of each horizontal and vertical plate. The horizontal restrictor plate 18 is defined as comprising flat plates of high Z value material which are oriented horizontally to restrict the flow of photons vertically. The vertical restrictor plate 19 is defined as comprising flat plates of high Z value material which are oriented vertically to restrict the flow of photons horizontally. Because of the angles involved, only the nearest eight restrictor plates (both horizontally and vertically) were chosen. Further plates would not add significance to the model and therefore it is assumed that after four grids in any one direction (eight plates vertically and eight plates horizontally) the photon flux is fully attenuated.

Attenuation is a factor of the amount of energy (photons) absorbed by either the restrictor plates 16 or the product material 14. On the other hand, buildup is a counterfactor of attenuation due to secondary photons being created by the initial attenuation of the material of the restrictor plates 16 or product target 14. In essence, when a photon is attenuated, it sometimes produces surviving photons which will continue to the product target 14 or target point, and therefore factor into the accumulated dose at that point. Target points are also defined relative to the origin point above on a Cartesian coordinate system for each cell calculation.

Once the cell 16 is calculated and fully mapped, the data are fed into other programs that use a relational Cartesian system based on cell units for both horizontal and vertical source point definition (y and z axis). For example, if the cell 16 is two inches wide and 4 inches high and the total source plaque 12 size is 40"×40", then the source plaque 12 would be defined as ten cells high by 20 cells wide. The target is defined in inches for its x and y axis. Its z axis is measured in inches. However, the interval between z planes selected is based on the vertical cell dimension.

MODEL RESOLUTION

Each source Cell is broken into 12 points horizontally and 12 points vertically (144 points total). Each target 14 is initially broken into one inch increments along its y axis (perpendicular to the flow of photons from the source plaque 12 into the product). The x axis is divided into 4 inch increments (distance into the product). If the product is 40"×40" then there would be 41 y axis points and 11 x axis points for each target plane on the z axis. The z axis is broken into increments at one vertical cell distance. Therefore, if the product were 40" high, and a cell had a vertical dimension of 5", then there would be 9 z axis planes of x and y coordinates.

Each time a source plaque 12 is divided into kernels or cells, the total accumulated dose for corresponding target points must be divided by the same amount so that the accumulation does not take into effect the same photons over the multiple times the source material is divided.

MODEL CALCULATIONS

Distance calculations are based on:

$$\text{distance} = \sqrt{(x_1 - x_2)^2 + (y_1 - Y_2)^2 + (z_1 - z_2)^2}$$

Restrictor plate attenuation is based on 10th. value thicknesses as follows:

Assume:

Restrictor material=lead

TVL (Lead 10th. value thickness for 0.662 MEV)=0.84"

distance=photon travel distance through the restrictor material then:

$$\text{attenuation}=10^{-(distance/0.84)}$$

Product attenuation is based on attenuation coefficients and buildup as follows:

Assume:

Attenuation Coefficient=0.857 g/cc=11.7 $(g/cc)^{-1}$

Average Bulk Product Density=g/cc

Inches to Centimeter conversion=2.54 cm/inch

Then:

$$\text{attenuation}=0.368^{[(distance)(2.54)(density/11.7)]}$$

$$\text{buildup}=4\ \exp[(0.302)(\text{distance})(2.54)(\text{density}/11.7)]$$

total attenuation=(attenuation)(buildup)

Specific Gamma-Ray Constant for Cesium-137

0.32 rads-meters$^2$/Curie-hours, wherein rads is a unit of absorbed dose in the product (100 ergs/gram), and curie is a measure of the amount of radioactivity ($3.7\times10^{10}$ disintegrations per second).

MODEL ATTENUATION DETERMINATION

After a specific source point coordinate and specific target point coordinate are determined, the distance is calculated through air and through product material to determine dose distribution to the target point based on product attenuation as well as the inverse of the distance squared. The model determines whether or not a photon collides with a restrictor plate. If so, the attenuation of that plate is factored into the equation.

The restrictor plates 18,19 are positioned by designating a theoretical restriction angle both vertically and horizontally. The distance between the plates is defined as:

distance=width/[tan(Θ/57.3)]

Where:

width=The distance between the front face and the rear face of the grid (inches), Θ=Restrictor Angle (degrees).

There are eight plates for each restriction orientation (horizontal and vertical). The horizontal restrictor angle is a theoretical restriction of photons from side to side (horizontally). It is measured in degrees from the source plaque plane. The vertical restrictor angle is a theoretical restriction of photons from top to bottom (vertically). It is measured in degrees from the source plaque plane.

MODEL GRID DIMENSION

There are four two-dimensional source plaques. Each would surround a hypothetical pallet of product. The distance between the product and the source (air gap) would depend on the specific dimensions of the product and the placement of the sources. As an example, the source 12 might be 7" away from each face 28 of a pallet of product target 14 assuming the product target 14 to be 48"×48" (length and width). If the width were 40" and the length 48" then two of the plaques would be 13" off of that face and two would be 7" off of the other two faces.

The radiation flux modifying grid 10 would come between the source plaque 12 and the product face 28. It is in the same orientation (x,y,z) as the source plaque 12. However, it need not be the same size as (y and z axis) as the source plaque 12. For example, the sources 12 might overlap the top of the grid 10, or perhaps the sides of the grid 10. This variance allows some control of the effect. To compensate for this effect, a second set of Cell data is run with only one variable change. This second set is referred to and has restrictor angles set to 0.00001 degrees (approaching, but not equal to zero).

The data generate the flux map of the dose rate within the product target 14 assuming grids 10 were not present. The second data in the Cell Technique series combines selected horizontal contributions from either the grids 10 or the non-grids dependent on how much overlap there is of the source 12 over the grid 10. Although not shown herein, a horizontal overlap component might be added to further control the grid's effect.

MODELING FLOW DIAGRAMS

FIGS. 5–12 contain a series of flow diagrams that are used to generate a full flux distribution for a specific set of parameters. The general parameters for this set are as follows:

Horizontal Restriction Angle=56 degrees

Vertical Restriction Angle=32 degrees

Distance from source to grid (front)=2.125 inches

Distance from front of grid to back of grid (restrictor width)=2.75 inches

Distance from restrictor grid (back) to product face=2.125 inches

Density of product=0.4 g/cc

Grid material=lead

Grid 1/10 value thickness=0.84 inches

Product dimensions=48"×48"×48"

Height of restrictor grid=6 vertical Cell heights

Vertical Source length=48"

Horizontal Source length=44"

Figure 5:
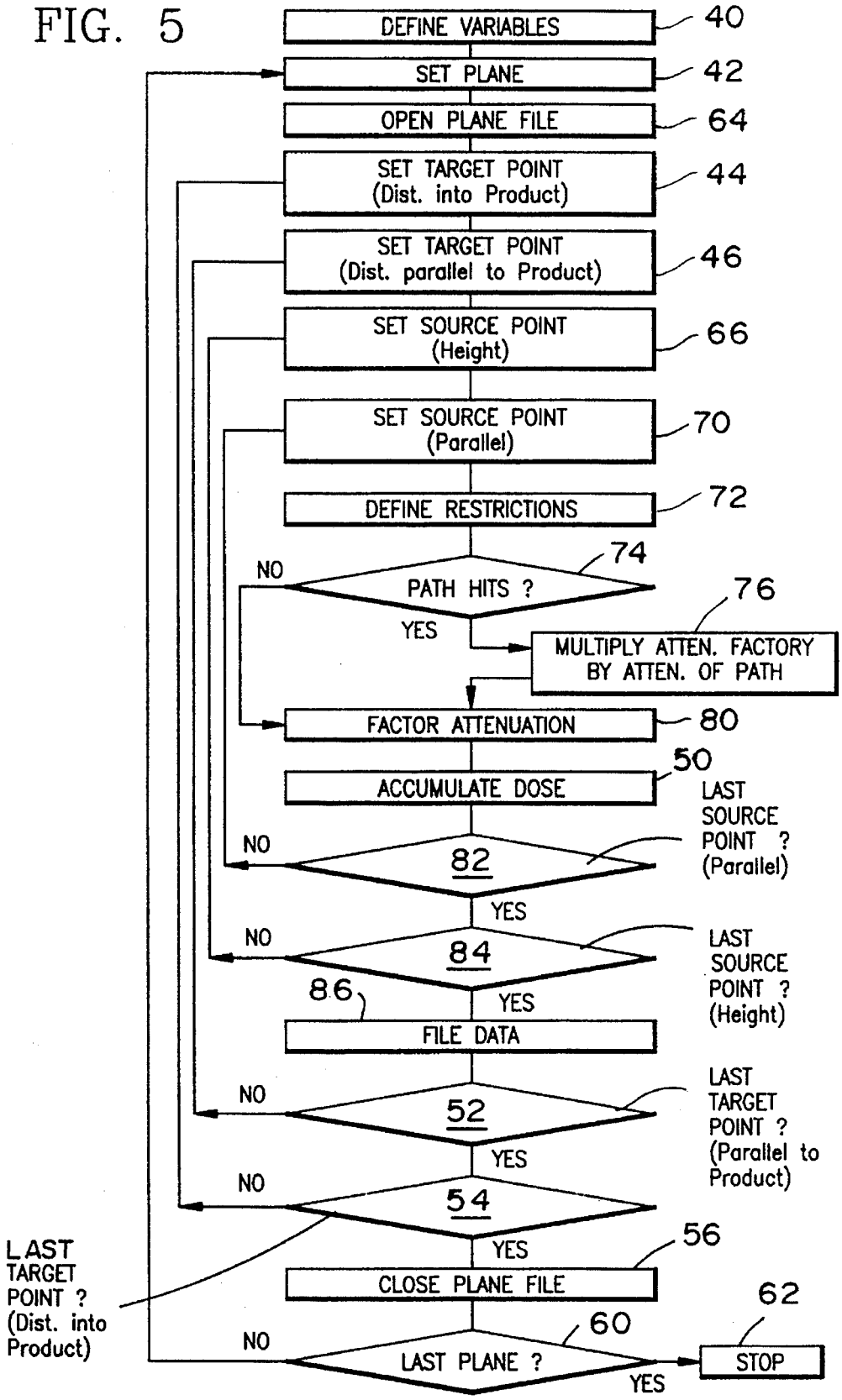
FIGS. 5 and 6 illustrate flow diagrams for creating full flux maps for specific cells in accordance with the present invention.
Figure 6:
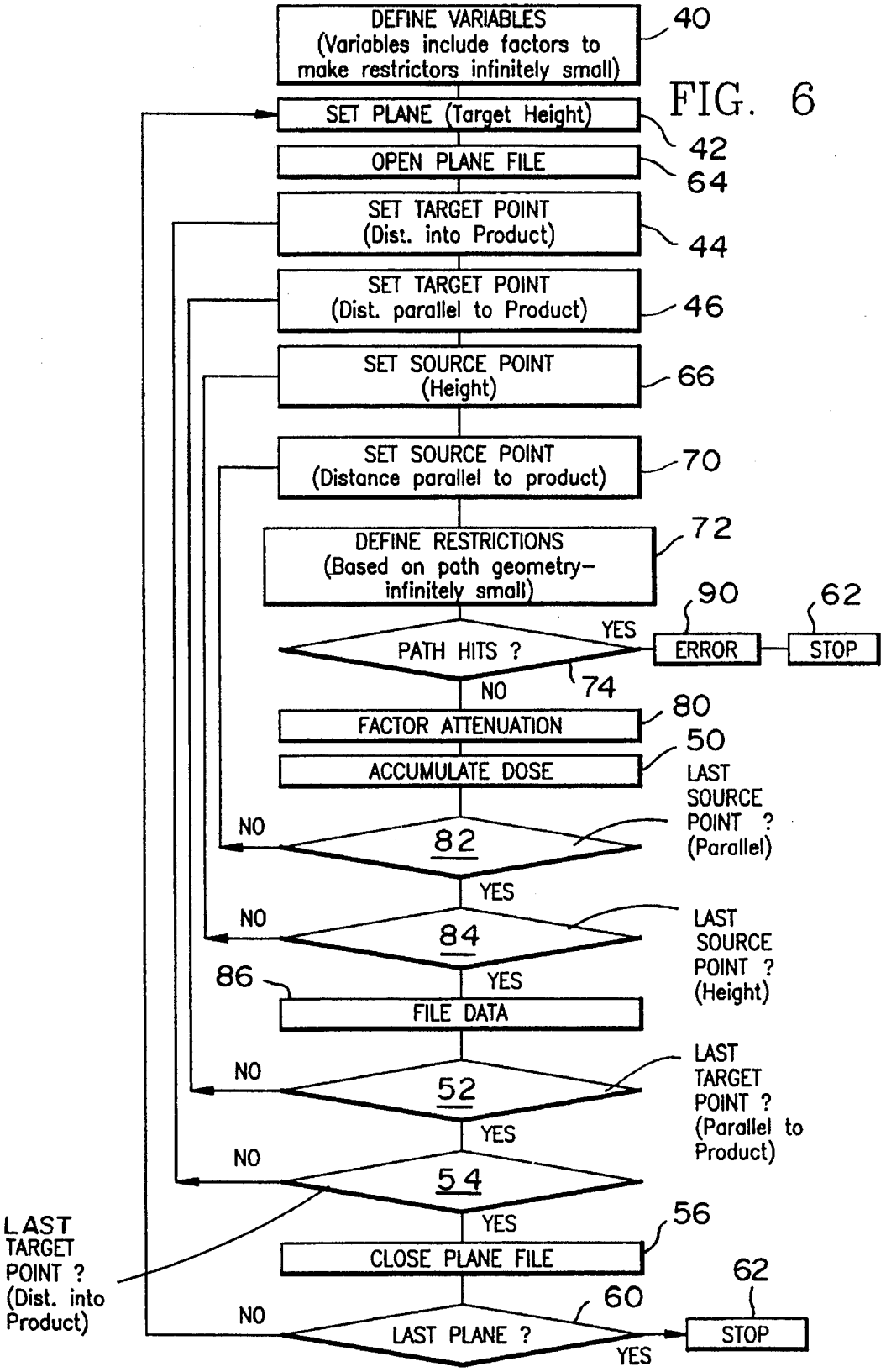
Figure 7:
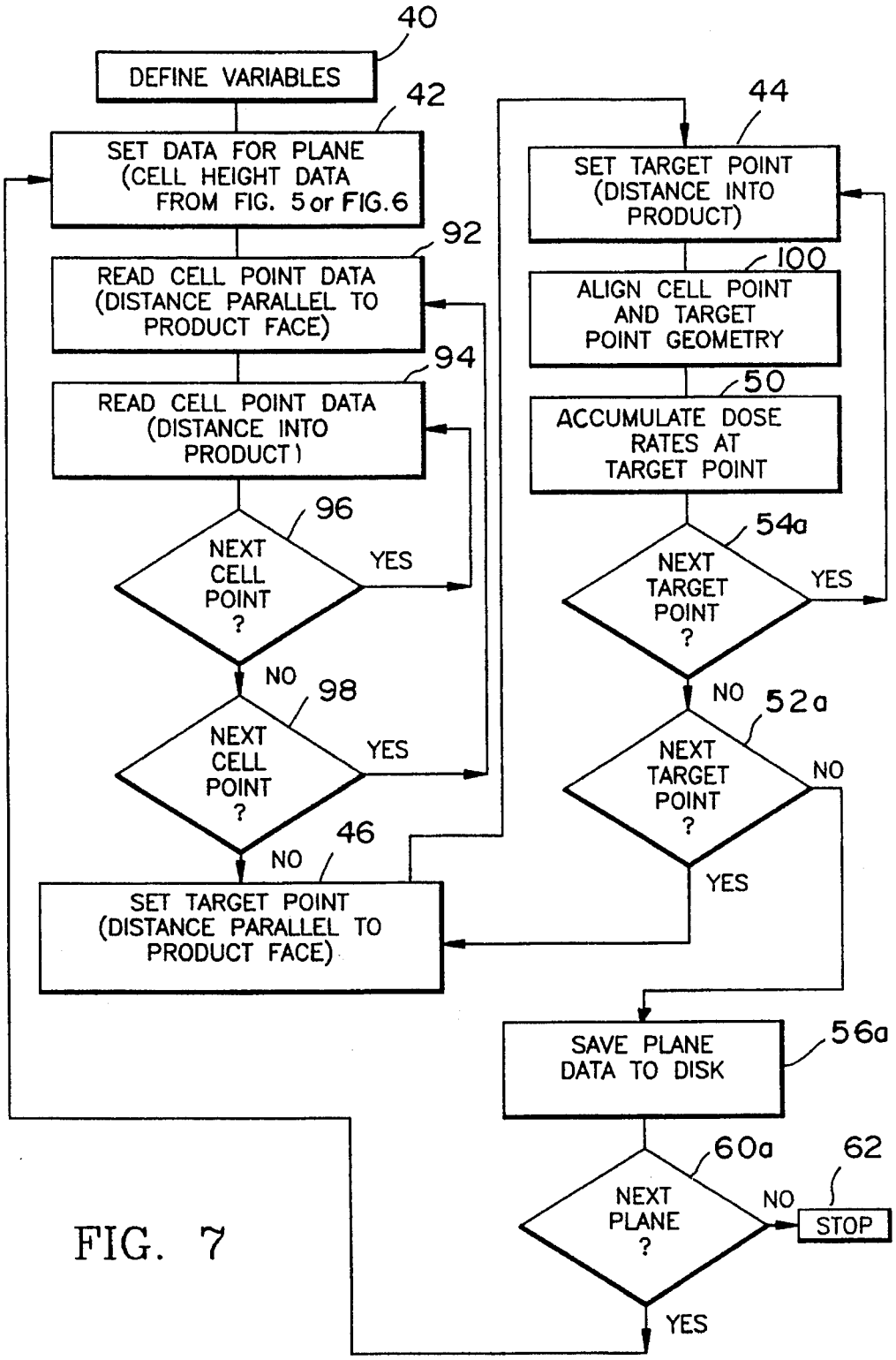
FIGS. 7 and 8 illustrate flow diagrams for calculating accumulations of effects for each cell in accordance with the invention.
Figure 8:
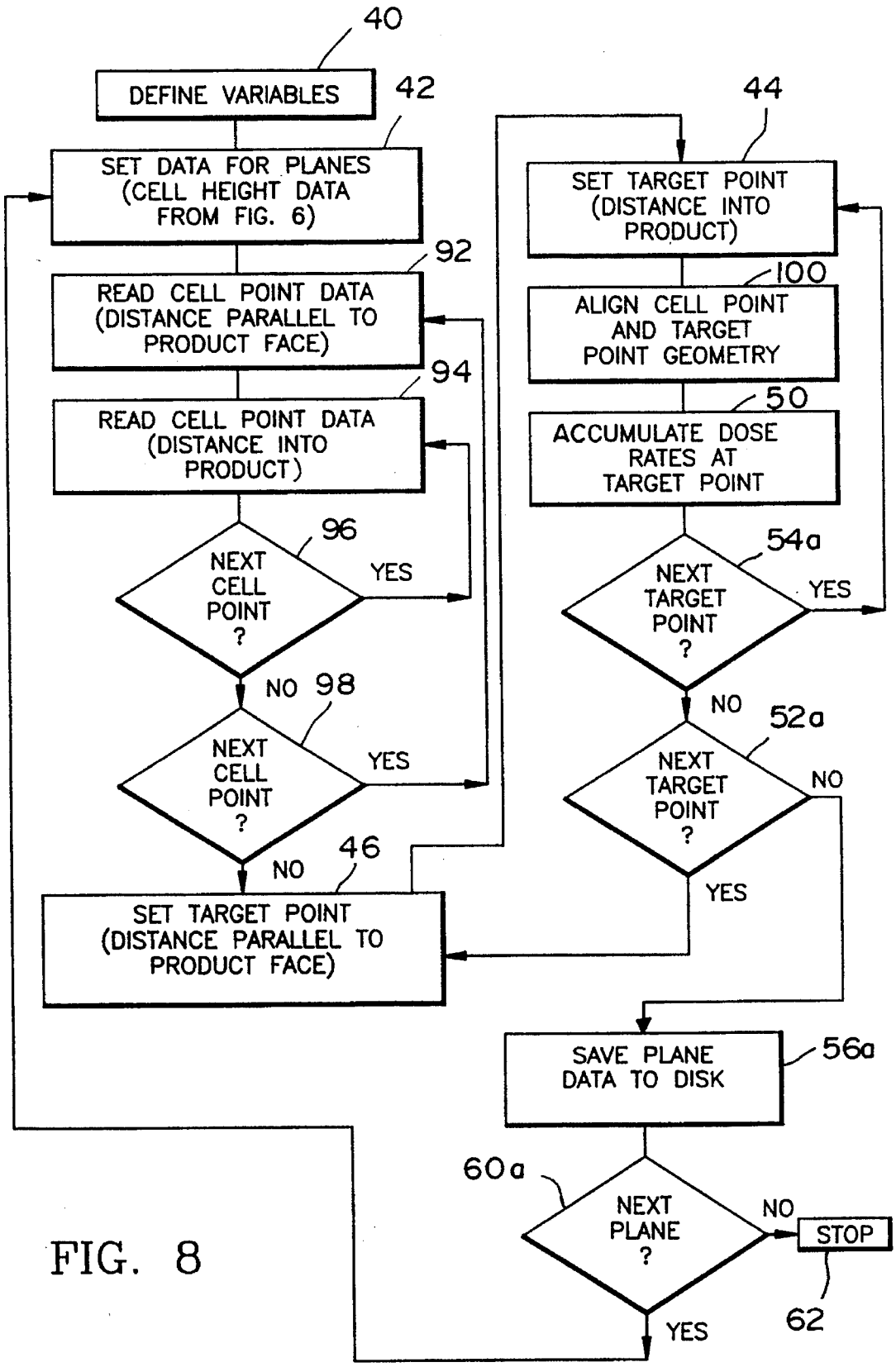

The model encompasses several flow diagrams modified for various parameter changes. The flow diagrams are generally divided into four basic functions. The first, as illustrated in FIGS. 5 and 6, create the full flux map for a specific Cell. The second, as shown in FIGS. 7 and 8, calculate the accumulation of the effect for each cell throughout a two dimensional target medium, assuming the cells were aligned in the configuration of a "horizontal line source". The third flow diagrams, shown in FIGS. 9 and 10, calculate the accumulation of each "horizontal line source" as though it were a two dimensional "source plaque" through a three dimensional target medium. The fourth flow diagrams, illustrated in FIGS. 11 and 12, juxtapose the three dimensional target medium for the four source plaque geometry of the irradiator utilizing four two-dimensional source plaques and their associated grids 10. This results in a three dimensional model of a specific product with specific dimensions using a specific grid 10 for a specific irradiator or source configuration. Accordingly, more detailed analyses of the program functions are described with reference to the appropriate figures.

To begin, the flow diagrams have some common features with each other. Accordingly, these common features are discussed and reference is made to FIG. 5, generally. The common steps of the flow diagrams are indicated by common numerals. The method is for modifying radiation flux utilizing a radiation flux polarizing grid 10 placed between a radiation source 12 and a product target 14.

The method comprises the initial step 40 of defining a plurality of variables for the radiation flux polarizing grid 10. The plurality of variables include at least one of the following: horizontal restriction angle, vertical restriction angle, distance from radiation source 12 to grid front, distance from front of grid 10 to back of grid 10, distance from polarizing restrictor grid 10 back to product target face 28, density of product target grid material, grid tenth value thickness, product target dimensions, height of restrictor grid, vertical radiation source length, and horizontal radiation source length.

Step 42 is the setting of a plane height, and step 44 includes the setting of a distance into product target 14 point.

The next common features are in step 46 setting a distance parallel to product face 28 target point, step 50 AC cumulating a dose rate at the target 14 point, and then a number of decision boxes. The first is box 52 determining if any more distance parallel to product face 28 target points exist and, if so, returning to step 46 setting a distance parallel product face 28 target point, otherwise continuing to next step. The next decision is made at box 54 wherein the flow determines if any more distance into product target 14 points exist and, if so, returning to step 44 setting a distance into product target 14 point, otherwise continuing to next subsequent step.

After the system completes the flow, the data is saved as indicated by box 56 saving plane generated data. A final decision is made in box 60 to determine if any further planes exist and, if so, returning to step 42 setting a plane height. Otherwise, the system modifies the radiation flux pattern of the radiation flux polarizing restrictor grid in box 62.

Now with specific reference to FIG. 5, the remainder of the steps are described in order to generate a flux pattern for at least one cell 16 using the radiation flux modifying grid 10.

In box 64, the plane file is opened. Box 66 sets a radiation source height point, and box 70 is for setting a distance parallel to radiation source face 28 point.

Now, in box 72, the restrictor locations 18, 19 on the radiation flux polarizing grid 10 are defined. At this point in the flow, the system begins testing for attenuation and buildup. The system, in box 74, determines the radiation paths which hit the restrictor locations. If a photon path 22 hits the restrictor plates 18, 19, the system multiplies an attenuation factor by the paths attenuating through the restrictor in box 76. Of course, if there are no hits such as photon path 20, the system moves to the next restrictor as shown in box 80.

As previously noted, the system flow begins to make a few decisions. First, the choice is made to determine if any further distance parallel to radiation source face points exist in box 82 and, if so, returning to step 70 of setting a distance parallel to radiation source 12 face point, otherwise continuing to next step.

Next, the system flow checks if any further radiation source height points exist in box 84 and, if so, the system returns to box 66 setting radiation source height, otherwise the system flow continues to the next step.

The data are saved in box 86 and the system generates a flux pattern for at least one cell 16 of the radiation flux polarizing grid 10.

The flow diagram of FIG. 6 is very similar to FIG. 5 and those commonalities have been indicated with like numerals. The steps which are different relate to the concept of generating a flux pattern for one cell 16 using no radiation flux modifying grid 10. Accordingly, in box 40 the defining of the variables are with infinitely small factors so there is an appearance of eliminating the restrictor plates 18, 19 of the radiation flux polarizing grid 10.

Because the object here is to give the appearance that the grid has been eliminated, at box 90 the system flow determines the radiation paths 20, 22 which hit the restrictor locations. If any indication of hit path 22 arises, then an error message is indicated. Of course, the system seeks no hits in order to move to next step. The system flow created and illustrated by FIGS. 5 and 6 have data which have been saved. These data are used in the system flow described with reference to FIGS. 7 and 8. In other words, a comparison is being generated. One system flow exists with the grid, FIGS. 5, 7, 9 and 11, and one with the appearance of no restrictors, FIGS. 6, 8, 10 and 12.

With reference now to FIG. 7, the system flow is generating a full flux pattern on positioning a number of cells horizontally. The flux pattern is not vertically integrated. In other words, it looks at a single horizontal line source and not a source plaque for each of the planes along the two axis. The flow diagram in step 42 combines elements or data generated from both FIGS. 5 and 6. Accordingly, in box 42, the setting of the plane height with data is from at least one cell 16 using radiation flux grid 10 or not using the radiation flux grid 10.

Again, there are commonalities and those steps have been indicated with similar numbers. Here, the data is now read from the cell 16, so in box 92 the system flow is reading distance parallel to product face cell point data, and in box 94, the system flow is reading a distance into product cell point.

Now, there are a number of decision boxes. The first is to determine if any further distance into product cell points exist in box 96 and, if so, returning to step 94 setting a distance into product cell point, otherwise continuing to next subsequent step. The next decision is made at box 98 where the system flow determines if any further distance parallel to product face cell point data exist and, if so, returning to step 92 setting a distance parallel to product face cell point data, otherwise continuing to next subsequent step.

At this point, a number of alignments are made so the system flow in box 100 begins aligning each cell and target points.

As previously noted, the data are saved, box 56, and a full flux pattern is generated based on the positioning of each cell point in a horizontal direction.

With reference to FIG. 8, the flow diagram is similar to that of FIG. 7, except in box 42 wherein the setting of plane height with data is from at least one cell 16. The grid 10 has been eliminated in appearance because there is no dependence on source overlap.

Figure 9:
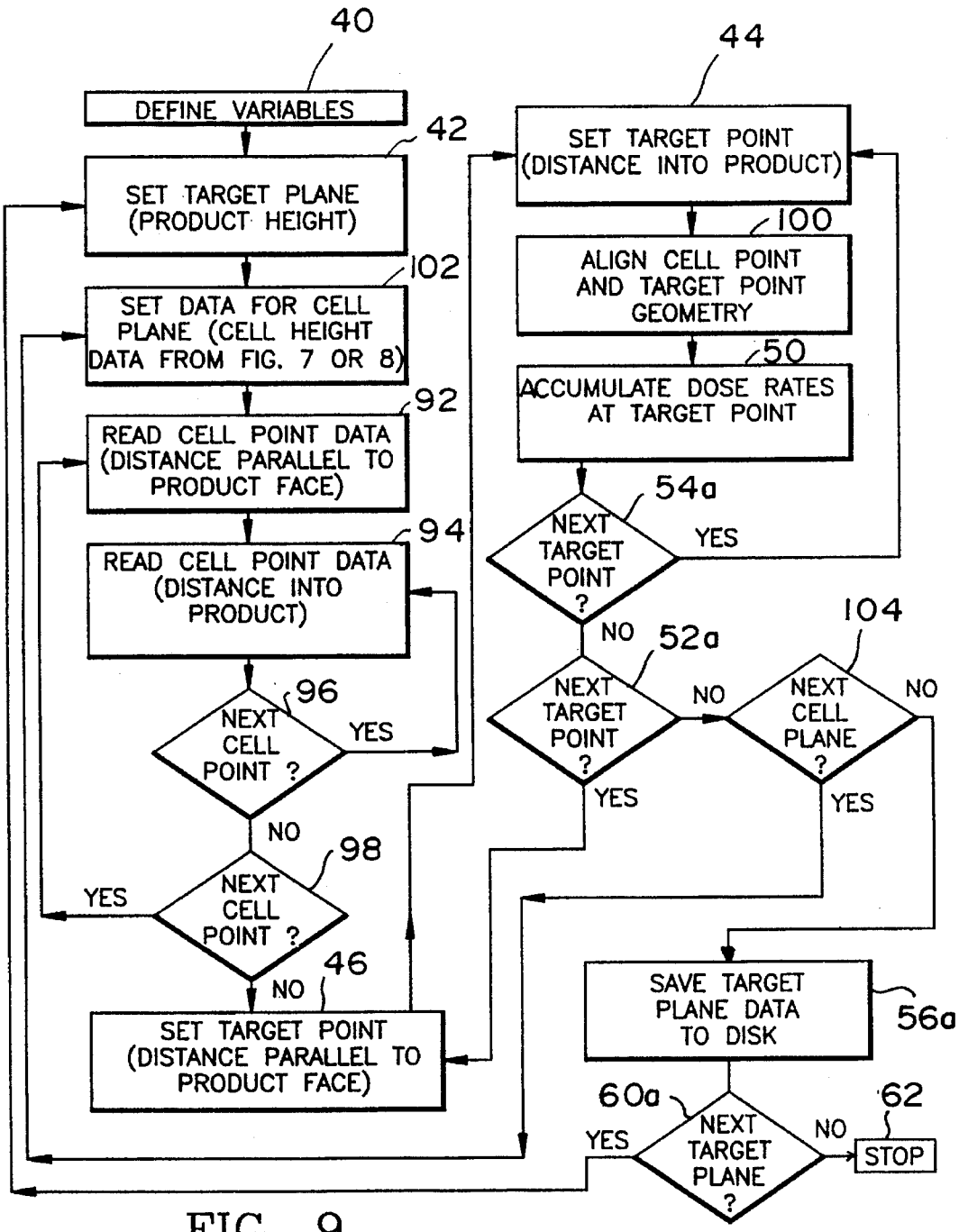
FIGS. 9 and 10 illustrate flow diagrams for calculating accumulations of each horizontal line source in accordance with the invention.

FIG. 9 illustrates the flow diagram for generating a full flux pattern for a plaque source based on the results generated through the flow diagram illustrated in FIG. 8 by vertically integrating the component planes.

Accordingly, in box 102, the flow begins by setting the plane with cell data from selections based on the height of the restrictor including any overlap.

A further decision, box 104, is necessary for determining if any further planes with cell data exists and, if so, returning to step 102 of setting the plane with cell data, otherwise continuing to next step. The data are saved in box **56*a* and the system flow finishes with the generating of a full flux pattern for the radiation source 12** by vertically integrating the planes.

Figure 10:
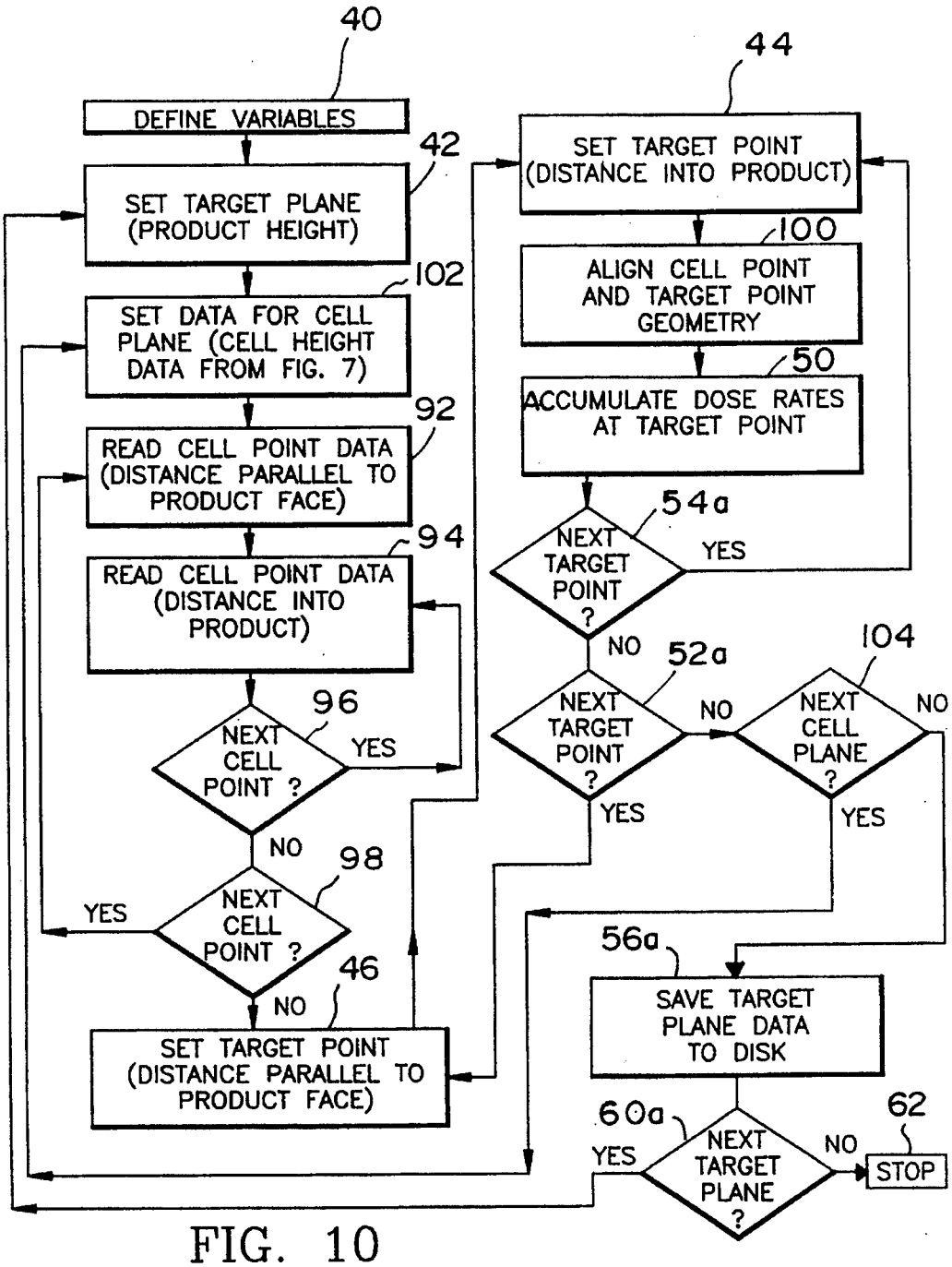

FIG. 10 is similar to FIG. 9 in that the modifying of radiation flux further includes step 102 of setting the plane with cell data from selections based on the height of the restrictor, and decision box 104 determining if any further planes with cell data exists and, if so, returning to step 102 of setting said plane with cell data, otherwise continuing to next step. The data is also saved and a full flux pattern for the radiation source is generated without the grid.

SAMPLE OUTPUT

FIGS. 13–17 contain sample outputs for the flow diagrams discussed. Each output has a grid 10 component as well as a non-grid component for comparison.

Figure 11:
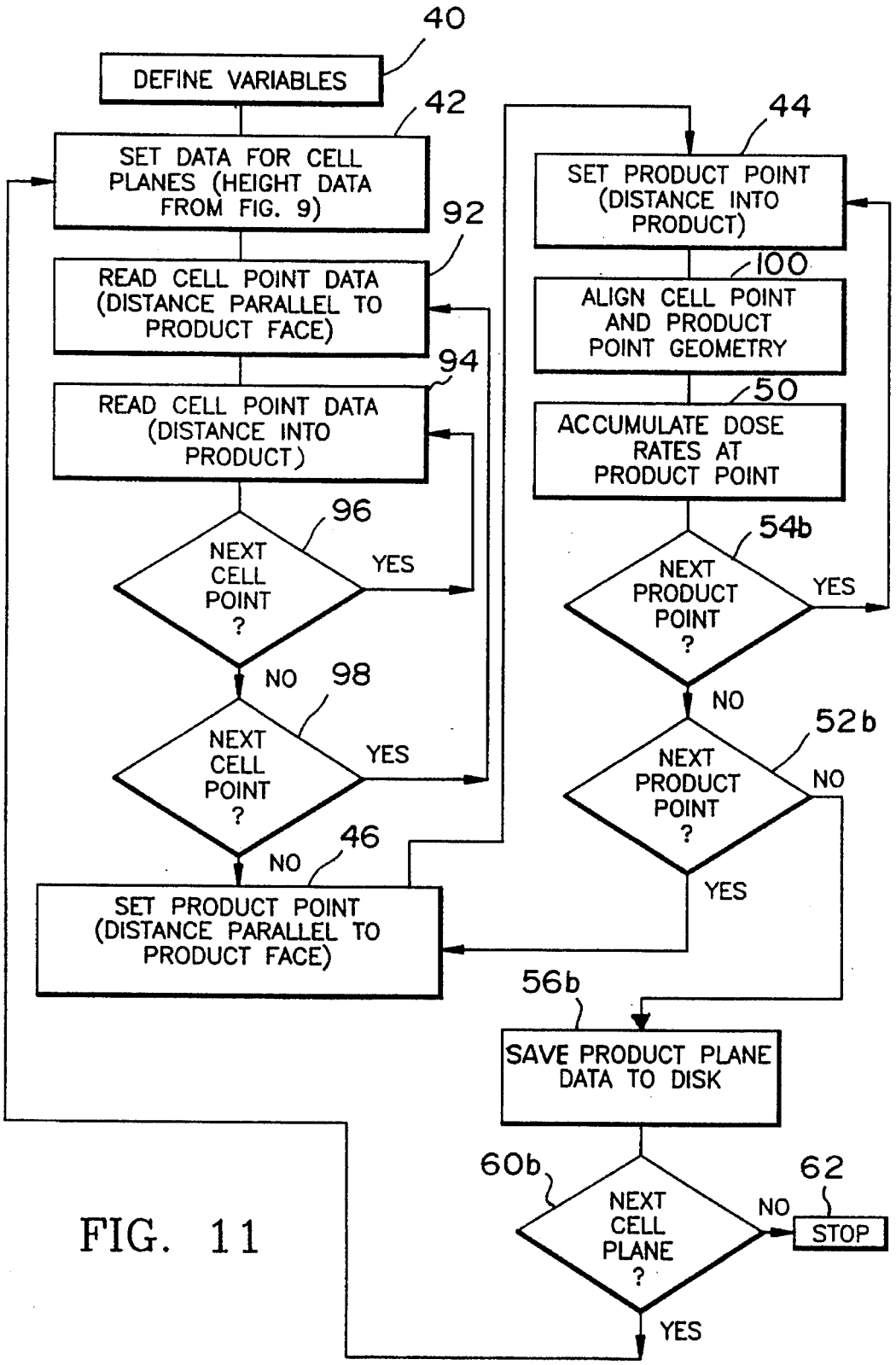
FIGS. 11 and 12 illustrate flow diagrams juxtaposing three dimensional target mediums in accordance with the present invention.
Figure 12:
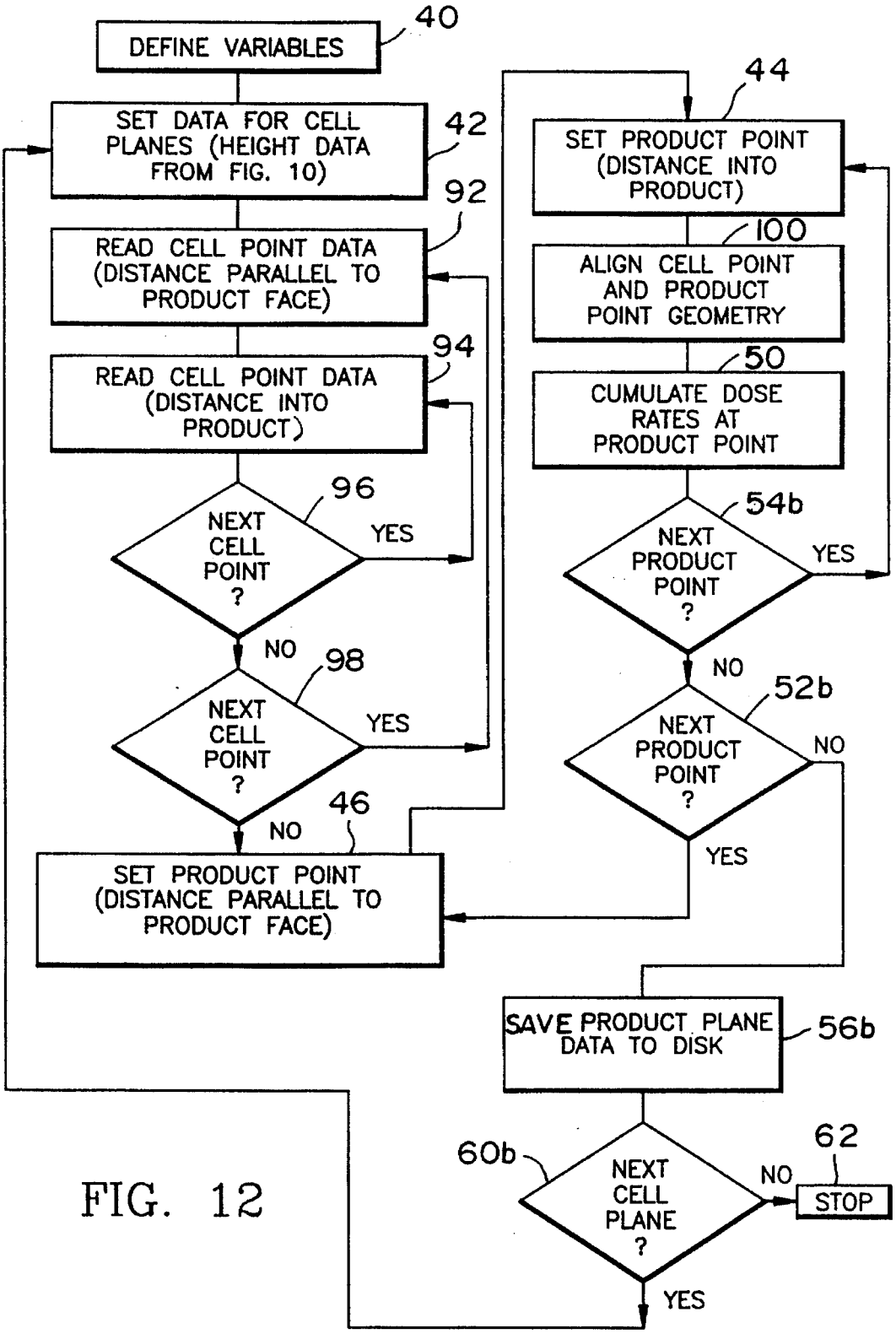

Now, FIGS. 11 and 12 are somewhat similar. The flow diagram illustrated in FIG. 11 takes the data from the flow of FIG. 9 and generates the final three dimensional flux pattern based on the contribution of all four two dimensional source plaques. The flow diagram illustrated in FIG. 12 takes the generated data from the flow diagram illustrated in FIG. 10 and generates a similar three-dimensional flux pattern.

Figure 13A:
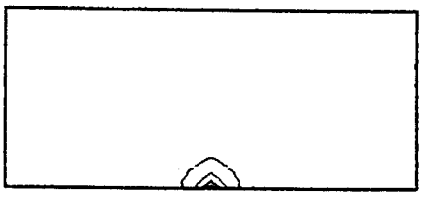
FIGS. 13AU–KU and AC–KC illustrate the flux of a single cell through hypothetical planes as they move vertically away from a plane on which a source point is located in accordance with the present invention.
Figure 13A:
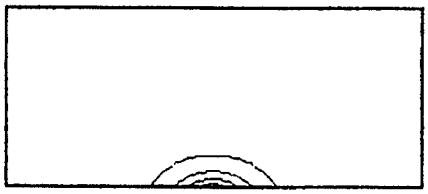
Figure 13B:
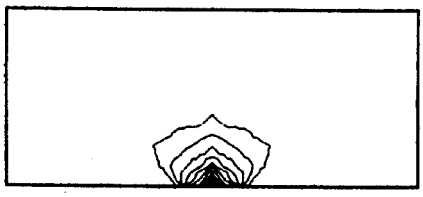
Figure 13B:
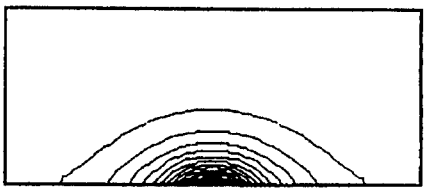
Figure 13C:
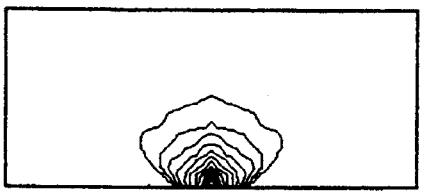
Figure 13C:
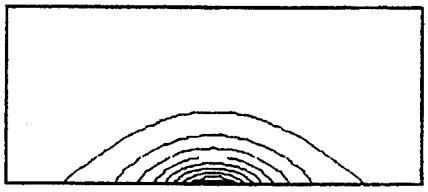
Figure 13D:
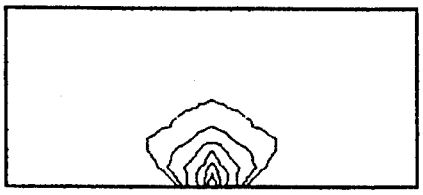
Figure 13D:
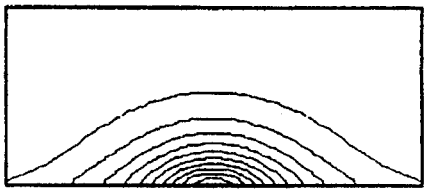
Figure 13E:
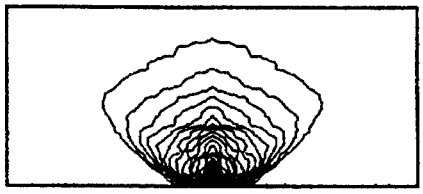
Figure 13E:
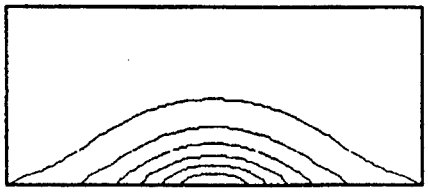
Figure 13F:
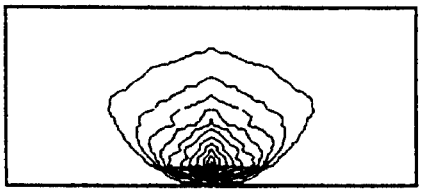
Figure 13F:
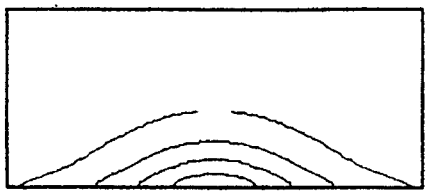
Figure 13G:
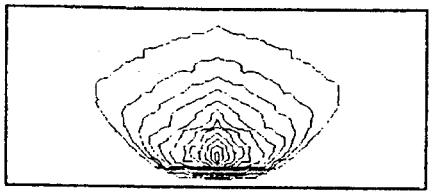
Figure 13G:
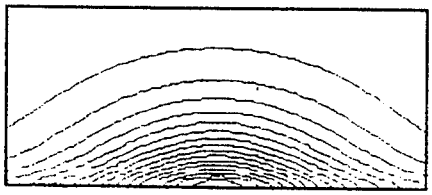
Figure 13H:
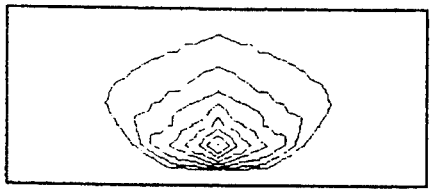
Figure 13H:
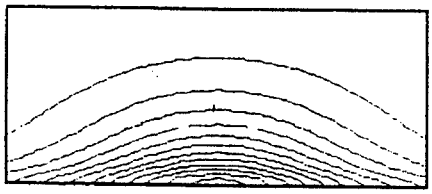
Figure 13I:
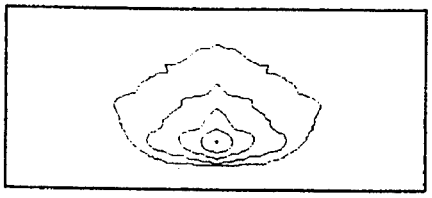
Figure 13I:
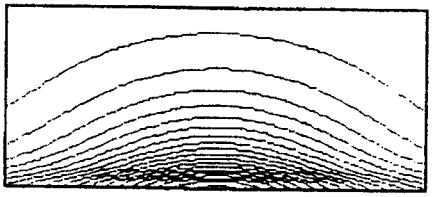
Figure 13J:
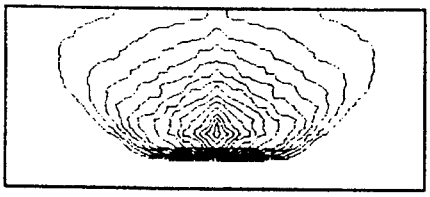
Figure 13J:
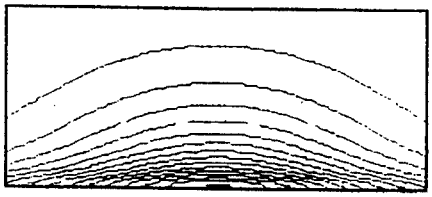
Figure 13K:
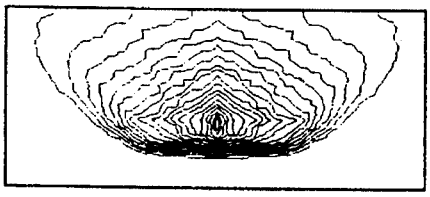
Figure 13K:
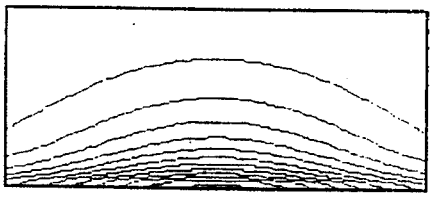

FIGS. 13AU–KU and AC–AK represent the flux of a single Cell through hypothetical planes as they move vertically away from the plane on which the source point is located. Each plane is one Cell distance (height) away from the previous plane. It is to be noted that the width of each plane extends beyond the bounds of the product width. This is to accommodate the positioning of the cells to their extreme. This also is true of the height of the mapping (the vertical planes extend beyond the product height). These illustrations are based on FIGS. 5 and 6.

Figure 14A:
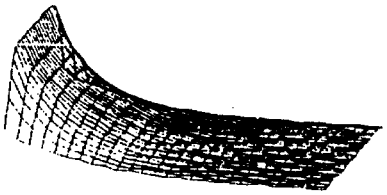
FIGS. 14AU–KU and AC–KC illustrate the flux distribution of a horizontal line source in accordance with the present invention.
Figure 14A:
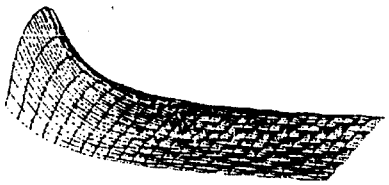
Figure 14B:
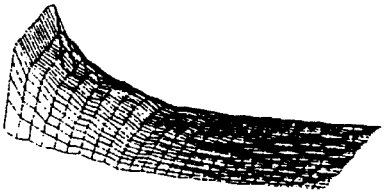
Figure 14B:
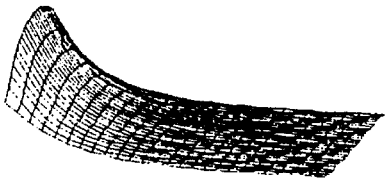
Figure 14C:
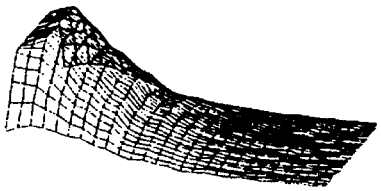
Figure 14C:
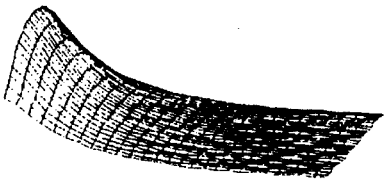
Figure 14D:
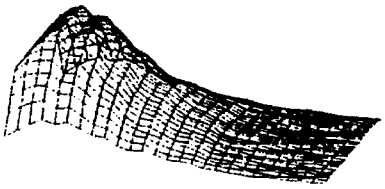
Figure 14D:
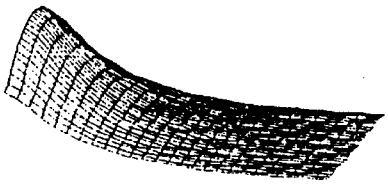
Figure 14E:
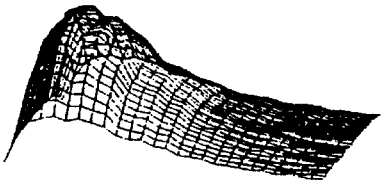
Figure 14E:
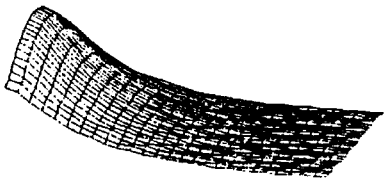
Figure 14F:
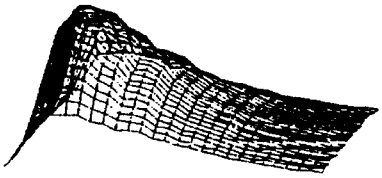
Figure 14F:
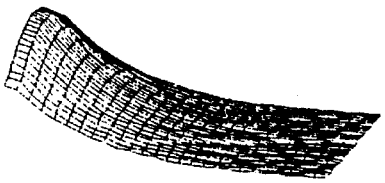
Figure 14G:
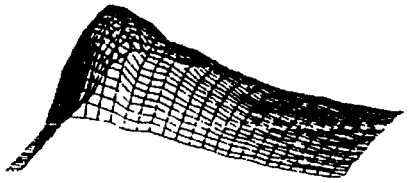
Figure 14G:
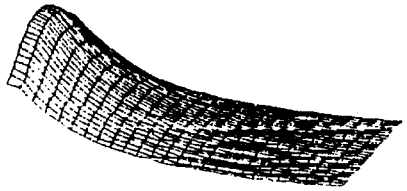
Figure 14H:
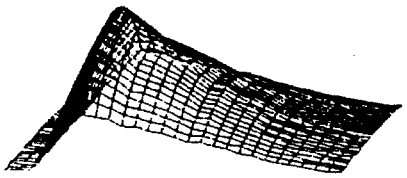
Figure 14H:
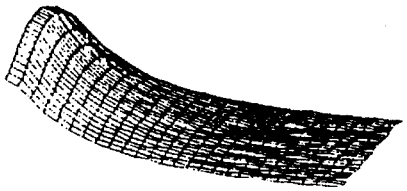
Figure 14I:
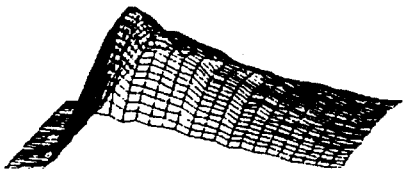
Figure 14I:
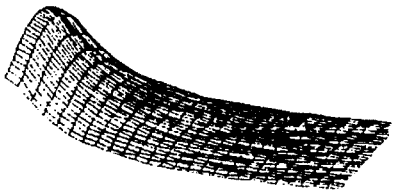
Figure 14J:
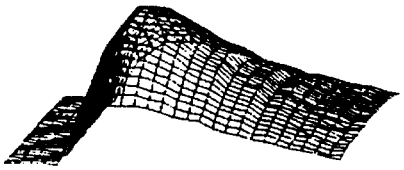
Figure 14J:
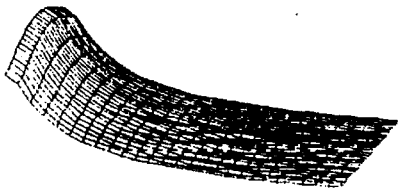
Figure 14K:
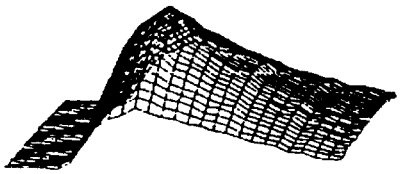
Figure 14K:
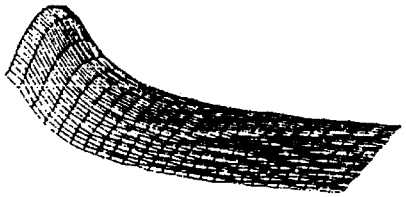

FIGS. 14AU–KU and AC–KC represent the flux distribution of a horizontal line source as calculated in the flow diagrams illustrated in FIGS. 7 and 8. The vertical component not yet added.

Figure 15A:
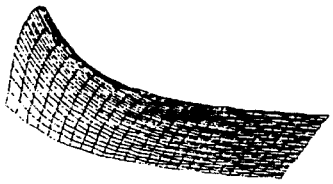
FIGS. 15AU–FU and AC–FC illustrate the flux distribution of a horizontal line source in accordance with the present invention.
Figure 15A:
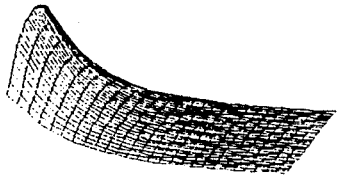
Figure 15:
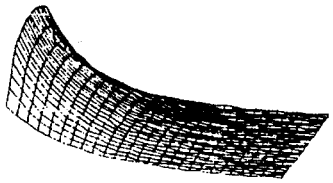
Figure 15B:
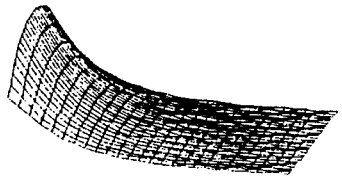
Figure 15C:
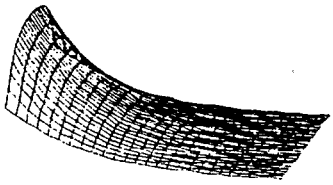
Figure 15C:
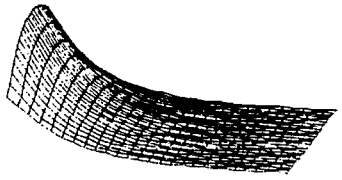
Figure 15D:
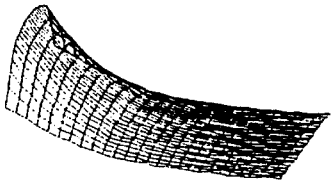
Figure 15D:
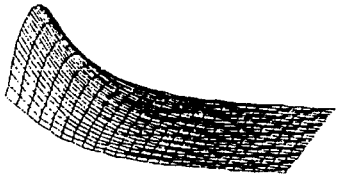
Figure 15E:
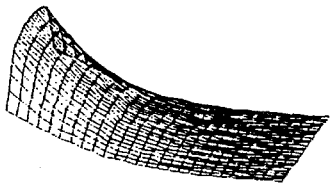
Figure 15E:
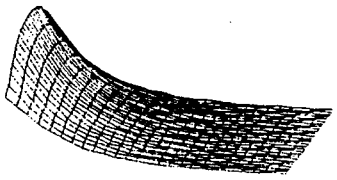
Figure 15F:
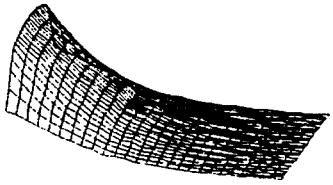
Figure 15F:
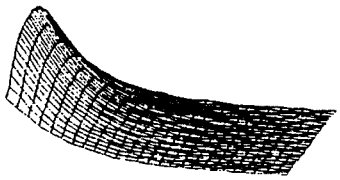

FIGS. 15AU–FU and AC–FC represent the flux distribution of a two dimensional source plaque as calculated in the flow diagrams illustrated in FIGS. 9 and 10. Each plane includes the contribution of the other planes.

Figure 16A:
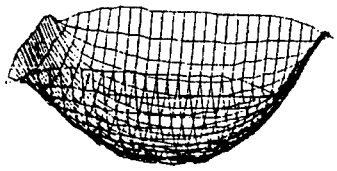
FIGS. 16AU–FU and AC–FC illustrate the full flux pattern of a product in accordance with the present invention.
Figure 16A:
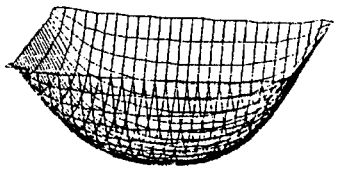
Figure 16B:
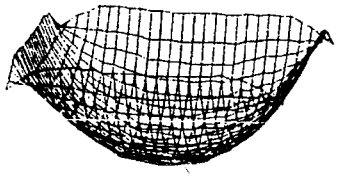
Figure 16B:
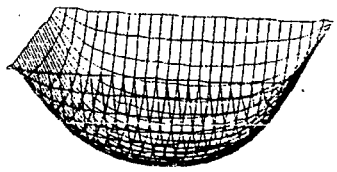
Figure 16C:
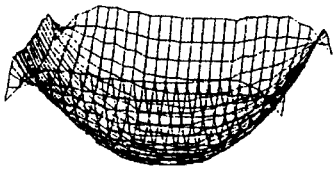
Figure 16C:
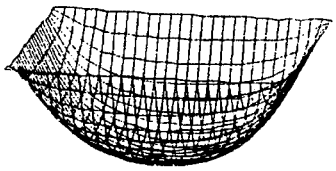
Figure 16D:
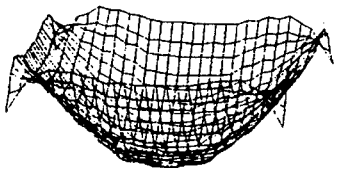
Figure 16D:
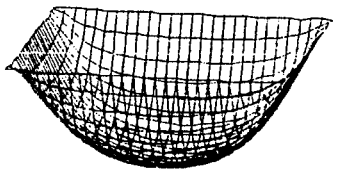
Figure 16E:
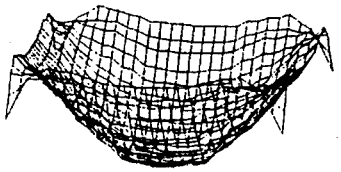
Figure 16E:
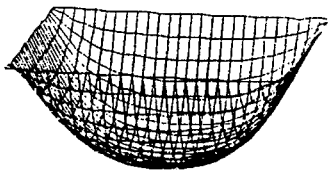
Figure 16F:
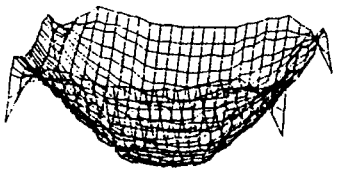
Figure 16F:
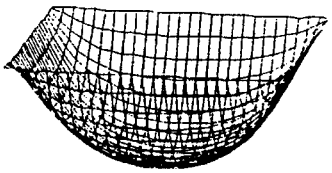

FIGS. 16AU–FU and AC–FC represent the full flux pattern of a 48"×48"×48" product using the previously indicated parameters. These illustrations are based on the results generated through the flow diagrams of FIGS. 11 and 12. Each slice is a representation of a plane of the product starting at the bottom plane, moving toward the center plane. One can interpolate the planes above the middle plane based on symmetry with the bottom half of the product. (surface plot)

Figure 17A:
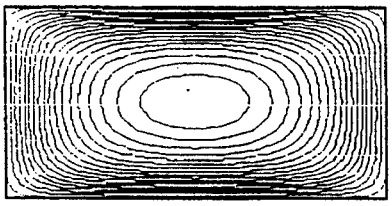
FIGS. 17AU–FU and AC–FC illustrate the full flux pattern of a product in contour plot format in accordance with the present invention.
Figure 17A:
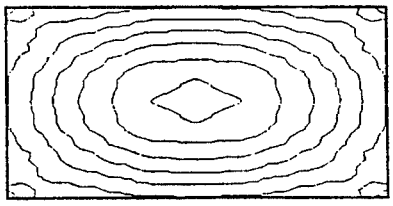
Figure 17B:
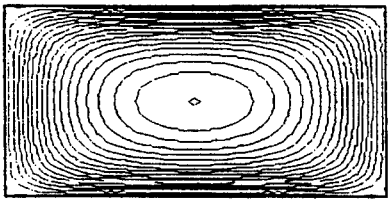
Figure 17B:
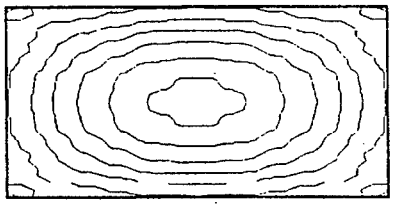
Figure 17C:
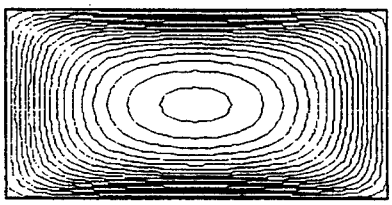
Figure 17C:
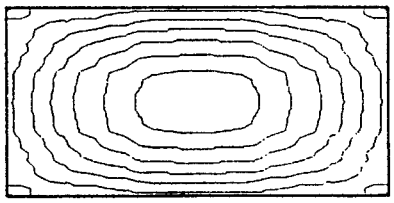
Figure 17D:
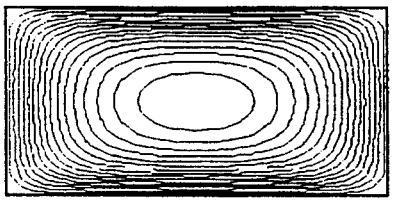
Figure 17D:
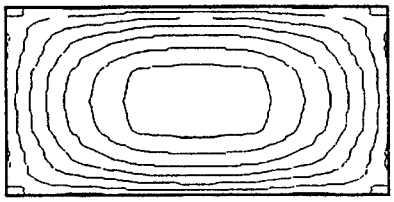
Figure 17E:
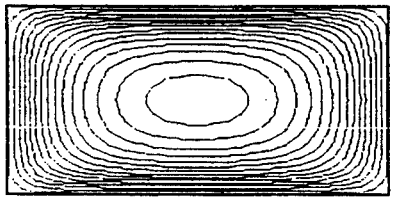
Figure 17E:
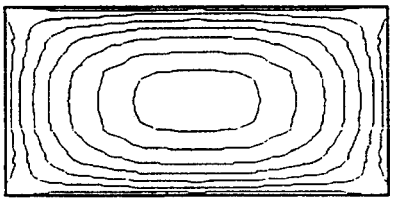
Figure 17F:
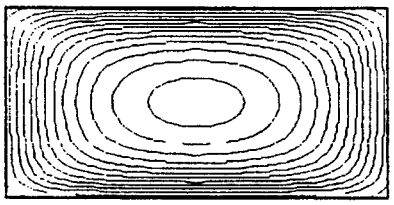
Figure 17F:
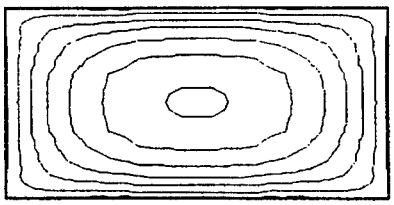

FIGS. 17AU–FU and AC–FC represent the same as FIGS. 16AU–FU and AC–FC except in contour plot format.

While the above description contains many specificities, these should not be construed as limitations on the scope of the invention, but rather as exemplification of one preferred embodiment thereof. Many other variations are possible. For example, as shown in FIG. 4, any number of other grid cell geometries and combinations can be utilized. These geometric patterns may be arranged vertically or horizontally, and it may be desirable to utilize non-uniform patterns such as changes in the variable spacing and element thickness as well as grid angles. Accordingly, the scope of the invention should be determined not by the embodiments illustrated, but by the appended claims and their legal equivalents.

I claim:

1. In an arrangement comprising source means for emitting photons and a three-dimensional target to be irradiated, a radiation flux distributor disposed between said source means and said three-dimensional target;

wherein said source means comprises a two-dimensional isotropic radiation source plaque for transmitting broad-beam radiation from a two-dimensional area occupied by said two-dimensional isotropic radiation source plaque to said radiation flux distributor, and said radiation flux distributor reduces the number of photons emitted by said source means and travelling at angles other than desired angles to said three-dimensional target; and wherein said radiation flux distributor comprises wall means defining at least one radiation through-passage for permitting said photons to pass generally linearly therethrough, and said wall means attenuates the photons travelling from said source means to said three-dimensional target at angles other than the desired angles;

whereby said radiation flux distributor substantially evenly distributes a three-dimensional flux of the photons throughout the three-dimensional target.

2. In the arrangement of claim 1, wherein said source means comprises a stationary two-dimensional isotropic radiation source plaque.

3. In the arrangement of claim 1, wherein said wall means comprises a grid defining a plurality of radiation through-passage cells.

4. In the arrangement of claim 3, wherein said cells are laterally aligned in side-by-side relation.

5. In the arrangement of claim 4, wherein said wall means comprise curvilinear walls.

6. In the arrangement of claim 3, wherein said wall means comprises planar walls.

7. In the arrangement of claim 6, wherein said planar walls define cells of polygonal cross-sectional configuration.

8. In the arrangement of claim 7, wherein said cells are of rectangular cross-sectional configuration.

9. In the arrangement of claim 7, wherein said cells are of a cross-sectional configuration having at least three sides.

10. In the arrangement of claim 9, wherein said cells are of a honeycomb cross-sectional configuration.

11. A method for modifying radiation flux utilizing a radiation flux polarizing grid placed between a radiation source and a product target and characterized by a radiation flux pattern, said method comprising the steps of:

defining a plurality of variables for the radiation flux polarizing grid, said plurality of variables including at least one of horizontal restriction angle, vertical restriction angle, distance from radiation source to grid front, distance from front of grid to back of grid, distance from polarizing restrictor grid back to product target face, density of product target grid material, grid tenth value thickness, product target dimensions, height of restrictor grid, vertical radiation source length, and horizontal radiation source length;

setting a plane height;

setting a distance into a product target point;

setting a distance parallel to a product face target point;

accumulating a dose rate at the target point;

determining if any more distance parallel to the product face target points exists and, if so, returning to the step of setting a distance parallel to the product face target point, otherwise continuing to the next step;

determining if any more distance into the product target points exists and, if so, returning to the step of setting a distance into the product target point, otherwise continuing to the next subsequent step;

saving plane generated data;

determining if any further planes exist and, if so, returning to the step of setting the plane height, otherwise modifying the radiation flux pattern of said radiation flux polarizing grid.

12. The method for modifying radiation flux of claim 11, further comprising the steps of:

defining said variables with infinitely small factors so there is an appearance of eliminating each restrictor of said radiation flux polarizing grid;

setting a radiation source height point;

setting a distance parallel to a radiation source face point;

defining restrictor locations;

determining the radiation paths which hit the restrictor locations and indicating an error message or, if there are no hits, moving to a next restrictor;

determining if any further distance parallel to the radiation source face points exist and, if so, returning to said step of setting a distance parallel to the radiation source face point, otherwise continuing to the next step;

determining if any further radiation source height points exist and, if so, returning to said step of setting a radiation source height point, otherwise continuing to the next subsequent step;

multiplying said accumulated dose by an attenuation factor; and generating a flux pattern for at least one cell.

13. The method for modifying radiation flux of claim 12, further comprising the steps of:

setting said plane height with data from said at least one cell;

reading distance parallel to product face cell point data;

reading distance into product face cell point data;

determining if any further distance into product face cell point data exist and, if so, returning to the step of reading distance into product face cell point data, otherwise continuing to the next subsequent step;

determining if any further distance parallel to product face cell point data exist and, if so, returning to the step of reading distance parallel to product face cell point data, otherwise continuing to the next step;

aligning said each cell point and said each target point; and generating a full flux pattern based on the positioning of said each cell point.

14. The method of claim 11, further comprising the steps of:

setting a radiation source height point;

setting a distance parallel to a radiation source face point;

defining restrictor locations on the radiation flux polarizing grid;

determining the radiation paths which hit the restrictor locations and multiplying an attenuation factor by the paths attenuation through the restrictor or, if there are no hits, moving to the next restrictor;

determining if any further distance parallel to the radiation source face point exists and, if so, returning to said step of setting a distance parallel to radiation source face point, otherwise continuing to next step;

multiplying said accumulated dose by an attenuation factor; and generating the flux pattern for at least one cell of said radiation flux polarizing grid.

15. The method for modifying radiation flux of claim 14, further comprising the steps of:

setting said plane height with data from said at least one cell using said radiation flux grid;

reading distance parallel to product face cell point data;

reading distance into product face cell point data;

determining if any further distance into product face cell point data exist and, if so, returning to the step of reading distance into product face cell point data, otherwise continuing to the next subsequent step;

determining if any further distance parallel to product face cell point data exist and, if so, returning to the step of reading distance parallel to product face cell point data, otherwise continuing to the next subsequent step;

aligning each of said cell points and said target points; and generating a full flux pattern based on the positioning of said each of said cell points in a horizontal direction.

16. The method for modifying radiation flux of claim 15, further comprising the steps of:

setting said plane with cell data from selections based on the height of the restrictor;

determining if any further planes with cell data exists and, if so, returning to said step of setting said plane with cell data, otherwise continuing to the next step; and generating a full flux pattern for said radiation source.

17. The method for modifying radiation flux of claim 15 or 13, further comprising the steps of:

setting said plane with cell data from selections based on the height of the restrictor including any overlap;

determining if any further planes with cell data exist and, if so, returning to said step of setting said plane with cell data, otherwise continuing to the next step; and generating a full flux pattern for said radiation source by vertically integrating said planes.

18. A method for producing a radiation flux polarizing grid having vertical and horizontal portions, said method comprising the steps of:

determining a distance between at least two vertical portions of said radiation flux polarizing grid;

determining a thickness of one of said vertical portions of said radiation flux polarizing grid;

determining a grid thickness of said radiation flux polarizing grid;

selecting a material for fabricating said radiation flux polarizing grid.;

calculating a centerline distance from a source plaque centerline to a grid centerline of said radiation flux polarizing grid;

calculating a face distance from said grid centerline to a face of a target product selected for irradiation;

selecting a product distance from said source plague centerline to a target product centerline; and producing said radiation flux polarizing grid having vertical and horizontal patterns with variable spacing, element thickness, and grid angles for polarizing radiation flux;

said method further comprising the steps of:

calculating the distance calculations based on $$\text{distance} = \sqrt{(x_1 - x_2)^2 + (y_1 - Y_2)^2 + (z_1 - z_2)^2} \quad ;$$

basing the restrictor plate attenuation on 10th. value thicknesses, wherein

Restrictor material=lead,

TVL (Lead 10th. value thickness for 0.662 MEV)= 0.84", distance=photon travel distance through the restrictor material, so that attenuation=$10^{-(distance/0.84)}$; and basing product attenuation on attenuation coefficients and buildup, wherein Attenuation Coefficient=0.857 g/cc=11.7 $(g/cc)^{-1}$;

Average Bulk Product Density=g/cc,

Inches to Centimeter conversion=2.54 cm/inch, so that attenuation=$0.368^{[(distance)(2.54)(density/11.7)]}$, and buildup=4 exp[(0.302)(distance)(2.54)(density/11.7)].

19. The method for producing the radiation flux polarizing grid of claim 18, further comprising the steps of:

selecting said material from at least one of the following: lead, depleted uranium and tungsten.

20. A method of producing the radiation flux polarizing grid having vertical and horizontal portions, said method comprising the steps of:

determining a distance between at least two vertical portions of said radiation flux polarizing grid;

determining a thickness of one of said vertical portions of said radiation flux polarizing grid;

determining a grid thickness of said radiation flux polarizing grid;

selecting a material for fabricating said radiation flux polarizing grid;

calculating a centerline distance from a source plaque centerline to a grid centerline of said radiation flux polarizing grid;

calculating a face distance from said grid centerline to a face of a target product selected for irradiation;

selecting a product distance from said source plaque centerline to a target product centerline; and producing said radiation flux polarizing grid having vertical and horizontal patterns with variable spacing, element thickness, and grid angles for polarizing radiation flux;

said method further comprising the step of:

defining the distance between the plates as distance=width/[tan(Θ/57.3)], wherein width=the distance between the front face and the rear face of the grid (inches), Θ=Restrictor Angle (degrees), total attenuation=(attenuation)(buildup), Specific Gamma-Ray Constant for Cesium-137 0.32 rads-meters$^2$/Curie-hours, and wherein rads is a unit of absorbed dose in the product (100 ergs/gram), and curie is a measure of the amount of radioactivity ($3.7\times10^{10}$ disintegrations per second).

21. The method for producing the radiation flux polarizing grid of claim 20, further comprising the steps of:

selecting said material from at least one of the following: lead, depleted uranium and tungsten.

* * * * *